US007600550B2

(12) United States Patent
Mays

(10) Patent No.: US 7,600,550 B2
(45) Date of Patent: Oct. 13, 2009

(54) AUTOMATIC BARRIER OPERATOR SYSTEM

(75) Inventor: Wesley M. Mays, Coppell, TX (US)

(73) Assignee: Overhead Door Corporation, Dallas, TX (US)

( * ) Notice: Subject to any disclaimer, the term of this patent is extended or adjusted under 35 U.S.C. 154(b) by 0 days.

(21) Appl. No.: 11/440,745

(22) Filed: May 25, 2006

(65) Prior Publication Data

US 2006/0254729 A1 Nov. 16, 2006

Related U.S. Application Data

(60) Continuation of application No. 10/620,731, filed on Jul. 16, 2003, which is a division of application No. 09/901,815, filed on Jul. 10, 2001, now Pat. No. 6,634, 408.

(51) Int. Cl.
*E05F 15/16* (2006.01)

(52) U.S. Cl. ..... 160/188; 49/25

(58) Field of Classification Search ..... 160/188, 160/201, 1, 7; 49/25; 340/5.71; 341/176; 318/16

See application file for complete search history.

(56) References Cited

U.S. PATENT DOCUMENTS

| | | | | |
|---|---|---|---|---|
| 4,365,250 | A | 12/1982 | Matsuoka et al. | |
| 4,602,255 | A | 7/1986 | Kitagawa et al. | |
| 4,665,395 | A | 5/1987 | Van Ness | |
| 4,942,393 | A | 7/1990 | Waraksa et al. | |
| 5,177,900 | A | 1/1993 | Solowiej | |
| 5,245,346 | A | 9/1993 | Nishimura et al. | |
| 5,291,193 | A | 3/1994 | Isobe et al. | |
| 5,319,364 | A * | 6/1994 | Waraksa et al. | 340/5.64 |
| 5,379,033 | A | 1/1995 | Fujii et al. | |
| 5,412,379 | A | 5/1995 | Waraksa et al. | |
| 5,442,341 | A | 8/1995 | Lambropoulos | |
| 5,453,736 | A | 9/1995 | Noren | |
| 5,473,318 | A | 12/1995 | Martel | |
| 5,499,022 | A | 3/1996 | Boschini | |
| 5,841,253 | A | 11/1998 | Fitzgibbon et al. | |

(Continued)

OTHER PUBLICATIONS

Issue Notification mailed Jul. 14, 2003 for U.S. Appl. No. 09/901,815.

(Continued)

*Primary Examiner*—Blair M. Johnson
(74) *Attorney, Agent, or Firm*—Gardere Wynne Sewell LLP; Kenneth R. Glaser

(57) ABSTRACT

An automatic barrier operator system for operating a gate or upward acting garage door, for example, includes a controller for operating a reversible motor, a base radio frequency transmitter and a base radio frequency receiver. One or more remote control units include a radio frequency remote receiver and remote transmitter. The controller is operable to automatically close or open the barrier in response to a query signal sent from the base transmitter to the remote receiver and when the remote receiver is within range, returning a signal to effect operation of the barrier. The system is operable to effect operation or maintain the status quo of the barrier depending on the state of the barrier and a particular signal or lack of signal received by the controller from an authorized remote control unit or units. The system provides essentially hands-free automatic operation of opening and closing a garage door and the like.

22 Claims, 6 Drawing Sheets

U.S. PATENT DOCUMENTS

| | | | | |
|---|---|---|---|---|
| 5,929,769 | A | 7/1999 | Garnault | |
| 5,942,985 | A * | 8/1999 | Chin | 340/5.61 |
| 5,973,611 | A | 10/1999 | Kulha et al. | |
| 5,990,828 | A | 11/1999 | King | |
| 5,998,950 | A | 12/1999 | Fitzgibbon et al. | |
| 6,011,468 | A | 1/2000 | Lee | |
| 6,049,289 | A | 4/2000 | Waggamon et al. | |
| 6,075,454 | A | 6/2000 | Yamasaki | |
| 6,107,938 | A | 8/2000 | De et al. | |
| 6,118,243 | A | 9/2000 | Reed et al. | |
| 6,172,430 | B1 | 1/2001 | Schmitz et al. | |
| 6,304,168 | B1 * | 10/2001 | Ohta et al. | 340/5.72 |
| 6,388,559 | B1 | 5/2002 | Cohen | |
| 6,522,027 | B1 | 2/2003 | Morillon et al. | |
| 6,559,775 | B1 | 5/2003 | King | |
| 6,615,132 | B1 | 9/2003 | Nagasaka et al. | |
| 6,617,961 | B1 | 9/2003 | Janssen et al. | |
| 6,911,898 | B2 | 6/2005 | Chung et al. | |
| 7,310,043 | B2 | 12/2007 | Mamaloukas | |
| 2004/0239482 | A1 | 12/2004 | Fitzgibbon | |

OTHER PUBLICATIONS

Office Action mailed Jan. 16, 2003 for U.S. Appl. No. 09/901,815.
Office Action mailed Sep. 30, 2002 for U.S. Appl. No. 09/901,815.
Office Action mailed Apr. 14, 2009 for U.S. Appl. No. 10/620,731.
Final Office Action mailed Oct. 8, 2008 for U.S. Appl. No. 10/620,731.
Office Action mailed Jan. 23, 2008 for U.S. Appl. No. 10/620,731.
Decision on Appeal decided Sep. 26, 2007 for U.S. Appl. No. 10/620,731.
Examiner's Answer mailed May 16, 2006 for U.S. Appl. No. 10/620,731.
Final Office Action mailed Apr. 6, 2005 for U.S. Appl. No. 10/620,731.
Office Action mailed Sep. 21, 2004 for U.S. Appl. No. 10/620,731.

* cited by examiner

AUTOMATIC BARRIER OPERATOR SYSTEM

CROSS REFERENCE TO RELATED APPLICATION

This application is a continuation of application Ser. No. 10/620,731, filed Jul. 16, 2003, which is a division of application Ser. No. 09/901,815, filed Jul. 10, 2001, now U.S. Pat. No. 6,634,408.

BACKGROUND OF THE INVENTION

In the art of barrier operator systems, such as upward acting garage door operators and gate operators, there has been a continuing need to improve the operating characteristics of such systems with respect to control and interaction between the operator system and persons using the facility at which the operator system is installed.

For example, in commercial and residential motor operated garage doors and the like, the operator control systems rely on human interaction to effect opening and closing of the door. However, in residential garage door installations, in particular, it is not unusual for persons using the garage door to forget whether or not the door is closed. Certainly, if a person opens the garage door and then drives away in their vehicle without closing the door, the security of the premises at which the door is installed has been compromised. The same is true for the situation wherein a person has returned to the garage, opened the door, driven their vehicle into the garage and then failed to close the door.

The aforementioned circumstances are just two of many event situations or states at which the failure of proper human interaction with the door operator system produces an unwanted result. Accordingly, there has been a need to develop an automatic garage door or other barrier operator system which overcomes problems associated with inadvertent failure to close or open a door, when needed, and provides the convenience of automating the operation of the door or a similar barrier. It is to these ends that the present invention has been developed.

BRIEF SUMMARY OF THE INVENTION

The present invention provides an automatic barrier operator system, particularly adapted for automatic operation of opening and closing a motor operated door or gate, such as a commercial or residential garage door, for example.

In accordance with one important aspect of the present invention an automatic barrier operator system is provided which utilizes a radio frequency transmitter and receiver system wherein a so-called base receiver and transmitter are operably associated with a base controller unit for controlling operation of a motor operator to move a door between open and closed positions. At least one remote, radio frequency control unit is associated with the system in such a way that when the remote control unit is outside of a certain range or distance from the base unit, the door or other barrier automatically moves from an open position to a closed position, for example.

In accordance with another aspect of the present invention, an automatic garage door operator system is provided which takes into account the door condition, whether it is open or closed, the previous operating mode whether or not it was automatic or manual, the location of one or more remote control units, namely whether they are within a predetermined range of the base unit or outside of a predetermined range, and whether or not the system detects the presence of an obstruction in the doorway.

Accordingly, the present invention also provides an automatic barrier operator system which includes a controller which is adapted to detect the presence of a remote operator control unit by sending an RF query signal to the remote control unit or units. If a remote control unit is within a predetermined range, it is activated to answer and, depending on the previous state of the door or barrier, the door or barrier is operated to move to an open position, for example. If the transmitter of the base controller fails to receive a response signal from at least one remote control unit after a predetermined number of queries, for example, and the door or barrier is in an open condition, then the door or barrier is closed, depending on what event placed in the door or barrier in the open position.

The present invention also provides a barrier operator system and a method for operating a door or gate which takes into account the state of the operator based on a previous event which moved a barrier such as a door or gate to an open or closed position, the location (in range or out of range) of one or more remote or portable control units and the previous inputs to the operator base unit which resulted in the present state of the door or gate. Thus, the present invention provides a barrier operator system and method which takes into account what type of event placed the door or similar barrier in its present state, the location of one or more remote control units and the last event or action input received from a remote control unit or a stationary or so-called wall mounted control unit near the barrier.

Those skilled in the art will further appreciate the above-mentioned advantages and superior features of the invention together with other important aspects thereof upon reading the detailed description which follows in conjunction with the drawings.

DETAILED DESCRIPTION OF THE PREFERRED EMBODIMENT

Figure 3A:
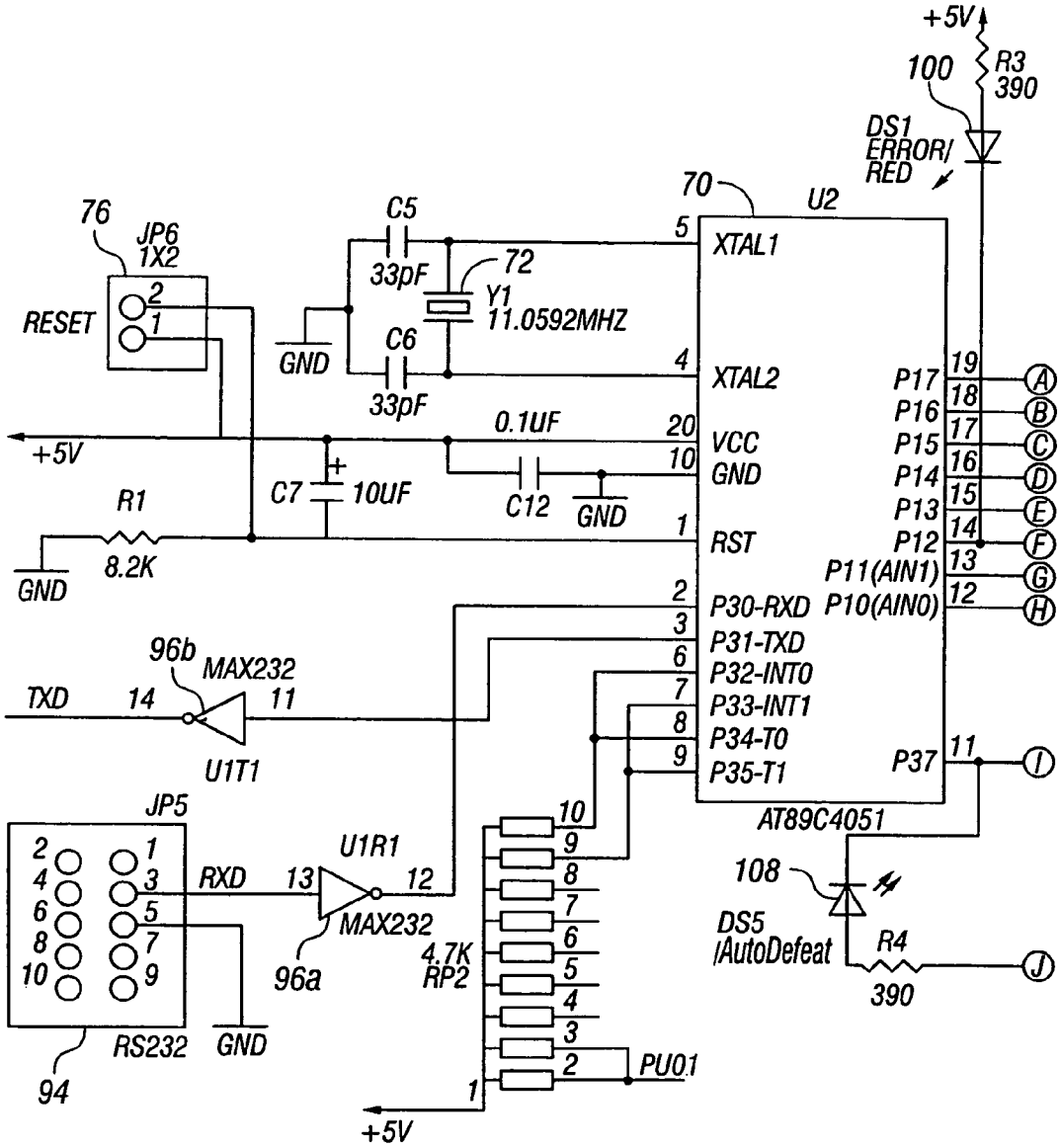
FIG. 3 is detailed circuit diagram of a major part of the so-called base controller for the barrier operator system of the invention and comprises FIGS. 3A, 3B and 3C which are intended to be read together.
Figure 3B:
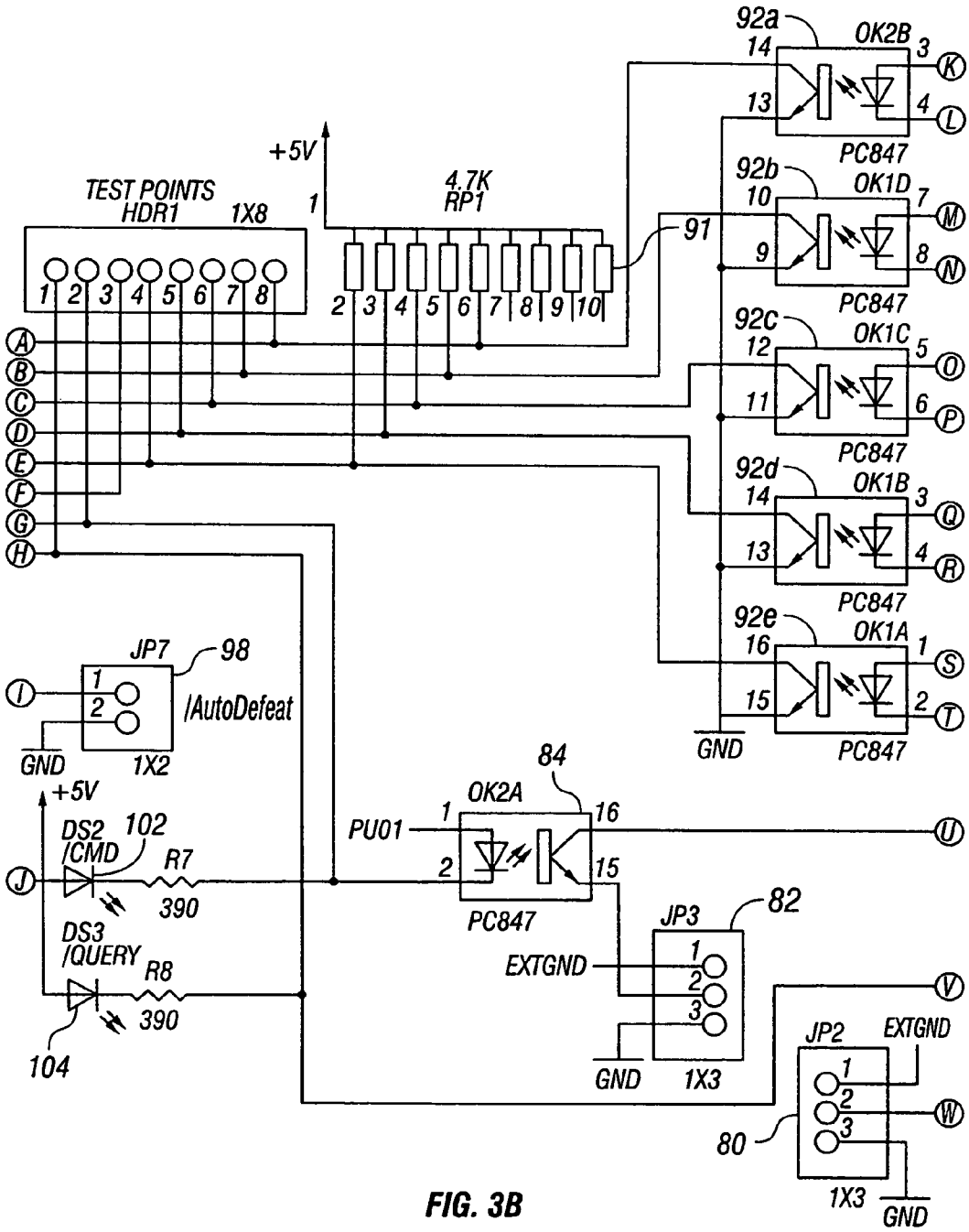
Figure 3C:
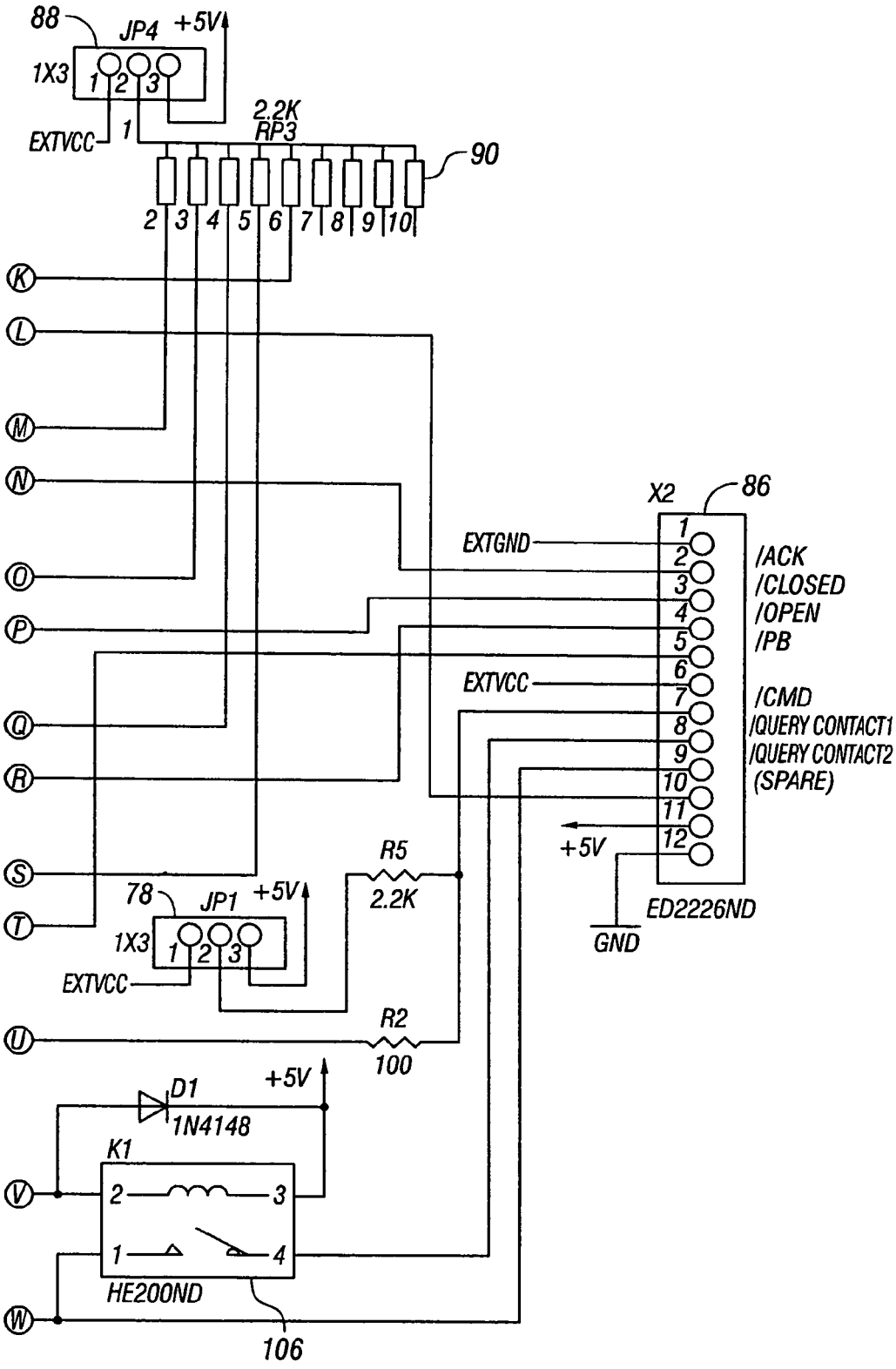

In the description which follows, like elements are marked throughout the specification and drawings with the same reference numerals, respectively. Certain components or elements may be shown in somewhat generalized or schematic form in the interest of clarity and conciseness. The circuit diagram components of FIGS. 3A, 3B and 3C are interconnected at the conductors labeled with the encircled capital letters A through W, respectively, as shown in the drawings.

Figure 1:
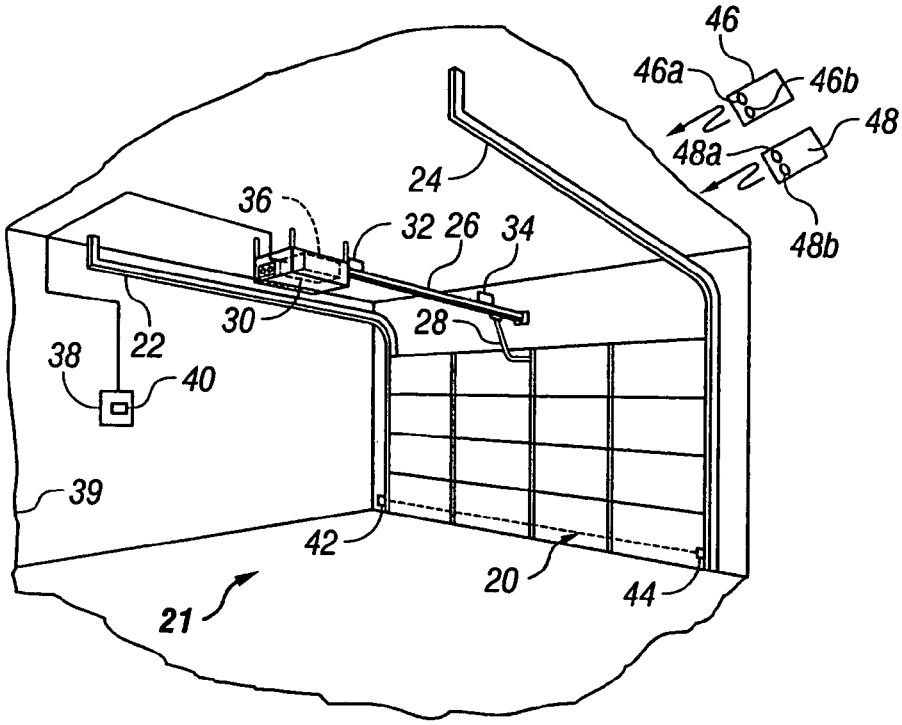
FIG. 1 is a perspective view of a motor operated upward acting garage door including the operator system of the present invention.

Referring to FIG. 1, there is illustrated an operator system for a movable barrier in accordance with the invention. In particular, there is illustrated a moveable barrier in the form of a sectional upward acting garage door 20 which is movable between a closed position shown and an open position along opposed parallel guide tracks 22 and 24, in a conventional manner. The door 20 is moved between its open and closed position by a motor driven operator system 21 which may include an operator mechanism of one of several types known in the art. One particularly advantageous type of operator is disclosed in U.S. Pat. No. 6,118,243 issued Sep. 12, 2000 to Reed et al. and assigned to the assignee of the present invention. The subject matter of U.S. Pat. No. 6,118,243 is incorporated herein by reference in its entirety. The operator system 21 illustrated in FIG. 1 includes an elongated support rail 26 for supporting a screw or chain type mechanism operably connected to a link 28 which is connected to the door 20. The aforementioned screw or chain mechanism is drivenly connected to a motor disposed within an operator housing 30, FIG. 1. Spaced-apart limit switches 32 and 34 are disposed on the rail 26 and may be of the type disclosed in U.S. Pat. No. 6,118,243. The limit switches 32 and 34 are operable to detect the position of the door 20, namely, whether it is open or closed.

Also disposed within the housing 30 is a major portion of an operator controller for the system 21 in accordance with the invention, and generally designated by the numeral 36. The controller 36 will be described in further detail herein. Still further, referring to FIG. 1, the operator system 21 includes a control unit 38 having at least one manually actuatable switch 40, thereon, which may be of the momentary or so-called push button type. The control unit 38 may be mounted on garage wall 39 or a location otherwise accessible by persons authorized to control operation of the system 21. Switch 40 may be one of a variety of types of devices responsive to direct operator intervention or control of the system 21. The automatic barrier operator system 21 may also be adapted to operate in conjunction with a doorway obstruction detector, including a signal sender unit 42 and a signal receiver unit 44. The obstruction detector 42, 44 may be of the photoelectric type, for example, and adapted to detect the presence of an obstruction in the doorway for the door 20 when the door is in an open position, for example.

As further shown in FIG. 1, the barrier operator system 21 may also include one or more remote control units 46 and 48, each provided with one, and preferably two, operator controlled switches which may be button type momentary switches 46*a*, 46*b*, 48*a* and 48*b*. The remote control units 46 and 48 are radio frequency type units and, by way of example, the unit 46 is also shown schematically in FIG. 2. The remote control units 46 and 48 may be substantially identical but may be programmed to emit radio frequency signals to the controller 36 having different signal characteristics to thereby identify themselves, respectively.

Figure 2:
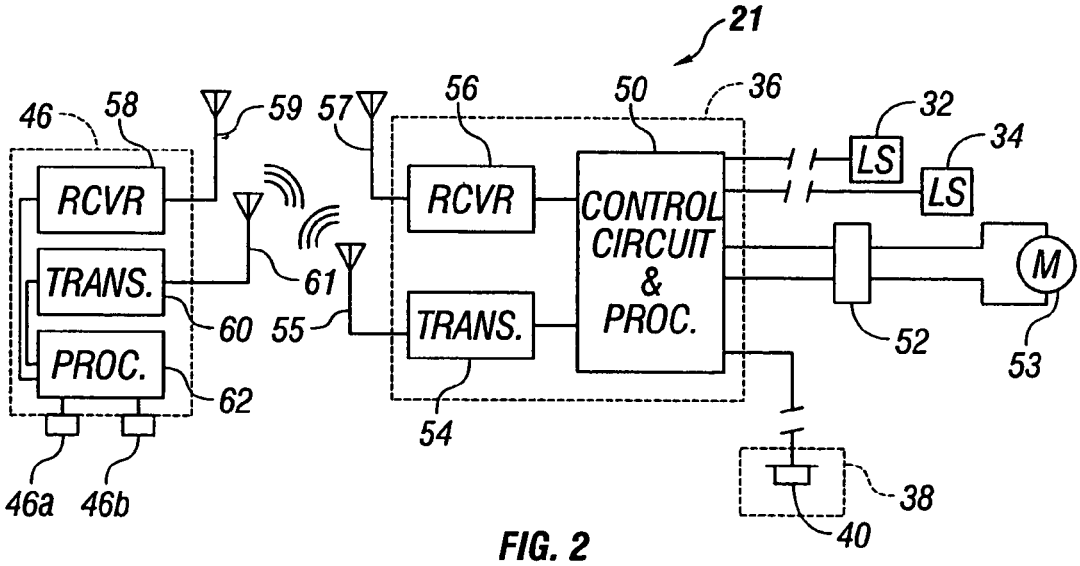
FIG. 2 is a general schematic diagram of the basic components of the operator system.

Referring now to FIG. 2, the controller 36 comprises a suitable control circuit 50 which includes a digital processor which will be explained in further detail herein. The control circuit 50 is operably connected to the limit switches 32 and 34 and to an operator motor 53 by way of a suitable interface circuit 52 for operating such motor in opposite directions, for example, to move the door 20 between open and closed positions. The motor 53 and associated drive mechanism may be of the type described in U.S. Pat. No. 6,118,243, for example. The controller 36 also includes a radio frequency transmitter 54 and a radio frequency receiver 56, each having suitable antennas 55 and 57 associated therewith, respectively. Alternatively, the controller 36 may include a single antenna connectable to the receiver 56 and transmitter 54 via suitable switch means. Moreover, the transmitter 54 and receiver 56 are also operably connected to the control circuit 50 whereby transmitter 54 may be caused to transmit a query or detection signal to the remote control unit 46. The receiver 56 is operable to receive a return signal from the remote control unit 46, which signal is then acted on by the control circuit 50 to effect a change of state of the barrier operator system to possibly, move the door 20 between an open position and a closed position, depending on the previous state of the door and other operating parameters.

Referring further to FIG. 2, the remote control unit 46 is illustrated generally, by way of example, and includes a radio frequency receiver 58 and a radio frequency transmitter 60, both operably connected to a suitable control circuit 62. The remote control unit 46 may, as mentioned above, include one or more so-called button-type momentary switches 46*a* and 46*b* for causing the remote control unit to send a coded signal by way of transmitter 60 to the receiver 56 of the controller 36. Accordingly, the controller 36 may transmit an activation signal to base transmitter 54 on a periodic basis causing transmitter 54 to send a query signal to receiver 58 by way of its antenna 59 and, if receiver 59 detects a signal from transmitter 54 which it can identify, then the remote control unit 46 provides a return signal by way of its transmitter 60 to the base receiver 56, said signal being transmitted through the respective antennas 61 and 57. Thus, if the control circuit 50 determines that the remote units 46 and/or 48 are within a predetermined range of the door 20, certain action may be initiated by the controller 36 to energize the motor 53 to move the door 20 to another position, depending on the state of the door, that is whether or not it is presently in an open or closed position, has been automatically or manually moved to its present position and whether or not an obstruction has been detected by the obstruction detector 42, 44.

Referring now to FIG. 3, a diagram of the control circuit 50 is illustrated. The control circuit 50 includes a microprocessor identified in the circuit diagram and also generally designated by the numeral 70. Processor 70 is operably connected to a clock circuit 72, a power supply filter circuit 74 and a reset circuit 76 which is suitably connected to a reset switch, not shown, for shorting terminals 1 and 2 of the circuit 76 to reset the processor 70. Plus five volts DC power is supplied to the control circuit 50, including the processor 70 via circuit 74, from a suitable source, not shown in FIG. 3. Connector 78 provides an internal or external voltage source by shorting connector pins 2 and 3 for an internal source or shorting connector pins 1 and 2 of connector 78 for an external source to be applied to pull up resistors and opto couplers for the circuit shown in FIG. 3. Connector 80 provides for selecting between an internal ground for the circuit 50 by shorting its pins 2 and 3 and an external ground by shorting its pins 1 and 2 for the /query contact 2 pin of the circuit. Connector 80 may be left open if no grounding of the output described is desired. Connector 82 is adapted to select between an internal ground by shorting its pins 2 and 3 or an external ground by shorting its pins 1 and 2 for an opto coupler 84 associated with a /CMD output signal terminal of the circuit 50 which is part of a connector 86, as shown.

Still further, referring to FIG. 3, a connector 88 is adapted to select between an internally generated plus five volts DC signal by shorting its pins 2 and 3 or an external voltage source by shorting its pins 1 and 2 for a set of pull up resistors 90 associated with respective opto couplers 92*a*, 92*b*, 92*c*, 92*d* and 92*e*, as shown. Communication between the circuit 50 and a host computer may be conducted by way of a connector 94 and RS232 drivers 96*a* and 96*b*. A connector 98 is provided, as illustrated, for connection to a defeat mechanism, if desired, for input to the processor 70.

Connections at the connector 86 provide for communicating signals between the processor 70 and external components by way of opto couplers 92*a* through 92*e*. Signal inputs to the control circuit 50 include the /ACK input terminal or pin which transmits a signal from the receiver 56 that an acknowledge signal has been received from a remote control unit, such as the unit 46. Connector terminal /CLOSED for the connector 86 conducts an active signal that the door 20 is in the fully closed position. This signal may be provided by way of circuitry associated with the limit switch 34, for example. The connector terminal associated with the /OPEN identifier for the connector 86 is for a signal received from the limit switch 32 that the door 20 is in an open position. Still further, a signal at the terminal /PB of the connector 86 is the input signal from the push button switch 40 to effect opening or closing of the door 20. The terminal /CMD of connector 86 is adapted to transmit a signal from the processor 70 to effect operation of the operator motor 53 to open the door 20. The terminals of connector 86 for /QUERY contact 1 and /QUERY contact 2 are operable to transmit signals to the transmitter 54 to cause it to send signals to the remote units 46 and/or 48 to determine if they are within range of the operator system, or not.

The microprocessor 70 contains a control program within a 4K flash memory. As mentioned previously, a host computer can be connected via connector 94 to view diagnostic information using a terminal emulator program. Referring further to FIG. 3, the control circuit 50 is also adapted to include several visual indicators including an indicator 100 which, when illuminated, indicates that a limit switch timer has expired, meaning that the door 20 was in motion between limit switches 32 and 34 but no limit switch was reached. Indicator 102, when illuminated, indicates that a command signal is active "low", meaning that the door 20 is being commanded to be opened or closed. Visual indicator 104 in FIG. 3, when illuminated, indicates that the query signal is active "low", meaning that a relay 106 used to send a query command to transmitter 54 is closed. A visual indicator 108 may be provided to be illuminated when pins 1 and 2 of connector or jumper 98 are shorted to indicate that a diagnostic function of the processor 70 has been activated.

In operation, the controller 36 in conjunction with the remote control units 46 and 48 is subject to several operational scenarios. Basically, the operator system 21 would be adapted to consider the remote control units 46 or 48 to be out of range if the remote control units were more than about one hundred feet to one hundred fifty feet from the door 20 and the controller 36. Accordingly, the control circuit 62, for example, of the remote unit 46, whose circuitry is essentially duplicated in the remote unit 48, could be set to require a certain signal strength of a query signal detected by its receiver 58 before commanding the transmitter 60 to send an acknowledgement signal. Of course, the transmitter 60 may also be actuated to transmit a signal to the controller 36 to open or close the door 20 by actuating one of the push button switches 46*a* or 46*b*. The purpose of two switches 46*a* and 46*b* is to enable the remote control unit 46 to be capable of opening more than one door, for example. Moreover, the remote control unit 46 may be operable to transmit a predetermined type of code, such as that described in U.S. Pat. No. 6,049,289 issued Apr. 11, 2000 to Waggamon, et al. and assigned to the assignee of the present invention. The subject matter of U.S. Pat. No. 6,049,289 is also incorporated herein by reference.

Operation of the controller 36 under so-called manual control should be established to take precedence at all times. In other words, manual operation caused by a signal from transmitter 60 to receiver 56 initiated by switch 46*a* or 46*b* or a signal initiated by actuating the push button switch 40 would supercede and cancel any automatic routine that would be currently in execution by the controller 36. However, the operator system 21 of the present invention provides to the user of the garage door 20 and its associated operator the freedom to not remember to open and shut the door 20 under a wide variety of operational situations. In addition, certain time out or timing factors may be incorporated into the controller 36 to overcome any inadvertent operation of the door 20. Moreover, the number of remote control units 46 or 48, may be more than two, if desired.

Figure 4:
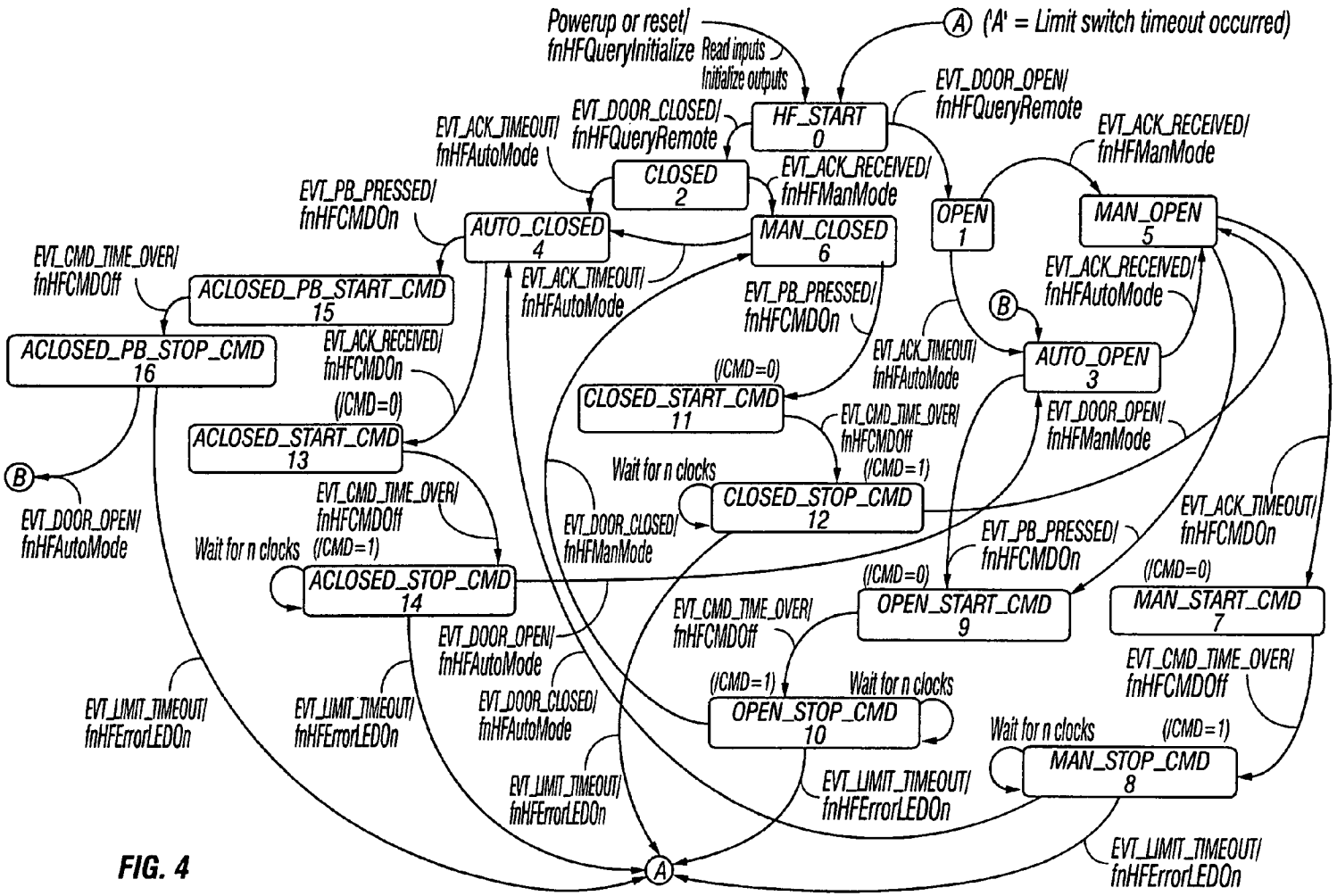
FIG. 4 is a state transition diagram for the barrier operator system.

Referring now to FIG. 4, there is illustrated a state transition diagram for the barrier operator system 21 of the present invention. The processor 70 may be programmed to carry out the changes in state of the system and the door position as a consequence of certain events which will be described hereinbelow. The states for the system identified as "States For The Main State Machine" are listed as follows, followed by a listing of "Events For The Main State Machine", and "Actions For The Main State Machine", respectively.

States For The Main State Machine: There are seventeen numbered states shown in FIG. 4 and which also have the following identifiers. HF_START indicates the beginning or idle state. OPEN indicates the door has been determined to be open. The machine remains in this state until a ACK signal is received from the remote or a timer for the ACK signal expires. CLOSED means the door 20 has been determined to be closed by examination of limit switch input signals. AUTO_OPEN means the door 20 is open due to the fact that the remote control unit (or units) is out of range. AUTO_CLOSED means the door 20 is closed, but the remote control unit 46 is out of range. MAN_OPEN means the door 20 is open, but the remote control unit 46 is in range. MAN_CLOSED means the door 20 is closed, but the remote control unit 46 is in range. MAN_START_CMD means the /CMD output has been set to logic '0'. In this state, the state machine waits for EVT_CMD_TIME_OVER to occur. MAN_STOP_CMD means that the /CMD output has been set back to logic '1' after the EVT_CMD_TIME_OVER has occurred. This completes the '1', '0', '1' pulsing of the /CMD output. This state remains until the door 20 is sensed to be closed by the closed limit switch 34 or a timeout timer for the error condition expires. OPEN_START_CMD means the /CMD output has been set to logic '0'. In this state, the state machine waits for EVT_CMD_TIME_OVER to occur. OPEN_STOP_CMD means the /CMD output has been set back to logic '1' after the EVT_CMD_TIME_OVER has occurred. This completes the '1', '0', '1' pulsing of the /CMD output. This state remains until the door 20 is sensed to be closed by the closed limit switch or the timeout timer for the error condition expires. CLOSED_START_CMD means the /CMD output has been set to logic '0'. In this state, the state machine waits for EVT_CMD_TIME_OVER to occur. CLOSED_STOP_CMD means the /CMD output has been set back to logic '1' after the EVT_CMD_TIME_OVER has occurred. This completes the '1', '0', '1' pulsing of the /CMD output. This state remains until the door 20 is sensed to be closed by the closed limit switch 34 or a timeout timer for the error condition expires. ACLOSED_START_CMD means the /CMD output has been set to logic '0'. In this state, the state machine waits for EVT_CMD_TIME_OVER to occur. ACLOSED_STOP_CMD means the /CMD output has been set back to logic '1' after the EVT_CMD_TIME_OVER has occurred. This completes the '1', '0', '1' pulsing of the /CMD output This state remains until the door 20 is sensed to be closed by the closed limit switch 34 or the timeout timer for the error condition expires. Moreover, on powerup, if the door 20 is closed, and no ACK is received from the remote control unit or units, the state of the main state machine is AUTO_CLOSED. If the pushbutton 40 is then pressed, EVT_PB_PRESSED takes the machine to state ACLOSED_PB_START_CMD where the /CMD output is set to "0" to begin opening the door. After the appropriate time, the /CMD output is set back to "1" in state ACLOSED_PB_STOP_CMD (this completes the "1", "0", "1" pulse of /CMD). If limit switch 32 is not reached then the EVT_LIMIT_TIMEOUT event takes the machine back to state HF_START with the ERROR LED illuminated. Assuming the limit switch 32 is reached, then EVT_AUTO_OPEN takes the state machine to state AUTO_OPEN. Here the door 20 is open, and the main state machine waits here until either the pushbutton 40 is pressed again or an ACK is received. Accordingly, the main state machine transitions from state AUTO_OPEN to state MAN_OPEN, caused by event EVT_ACK_RECEIVED described below, and from state MAN_CLOSED to state AUTO_CLOSED, caused by event EVT_ACK_TIMEOUT, also described below.

Events For The Main State Machine are as follows: Powerup or reset means the initial condition for the controller 36. EVT_DOOR_OPEN means the open limit switch 32 is activated, indicating that the door 20 is open. EVT_DOOR_CLOSED means the closed limit switch 34 is activated, indicating that the door 20 is closed. EVT_ACK_RECEIVED means that this event occurs when the query state machine determines that the remote control unit 46 responded (ACKnowledged) to a query command. EVT_ACK_TIMEOUT means this event occurs when a remote control unit does not respond to a query command, indicating that the remote control unit is out of range or its battery is exhausted. EVT_PB_PRESSED means the manual push button switch 40 or an equivalent has been actuated. EVT_CMD_TIME_OVER means the timer for pulsing the /CMD output '1', '0', '1' has expired. EVT_CLOSE_TIMEOUT means the timeout timer for measuring the maximum allowed time before the closed limit switch 34 is reached has expired, indicating an error condition (the door 20 may be stuck between open and closed positions, or broken). EVT_OPEN_TIMEOUT means a timeout timer for measuring the maximum allowed time before the open limit switch 32 is reached has expired, indicating an error condition (the door 20 may be stuck, or broken).

Actions For The Main State Machine are as follows: fnHFInitialize initializes variables, outputs, determines state of the limit switch input signals, and sets the appropriate event, EVT_DOOR_OPEN or EVT_DOOR_CLOSED, to start the state machine. If neither limit switch 32 or 34 is sensed, the state machine remains in the idle (HF_START) state. fnHFQueryRemote sets the event EVT_QUERY_REMOTE and sends it to the query state machine to perform the query. It also sets the /ERRORLED output to '1' to turn it off. fnHFManMode sets up any variables and outputs associated with entering the manual mode of operation. fnHFAutoMode sets up any variables and outputs associated with entering the auto mode of operation. fnHFCMDOn will set the /CMD output to logic '0', and will start the timeout timer for setting the event EVT_CMD_TIME_OVER. fnHFCMDOff will set the /CMD output to logic '1'. fnHFErrorLEDOn will set the /ERRORLED output to logic '0', which will illuminate the ERROR LED, signifying that neither the open nor closed limit switch was reached in a specified amount of time.

Figure 5:
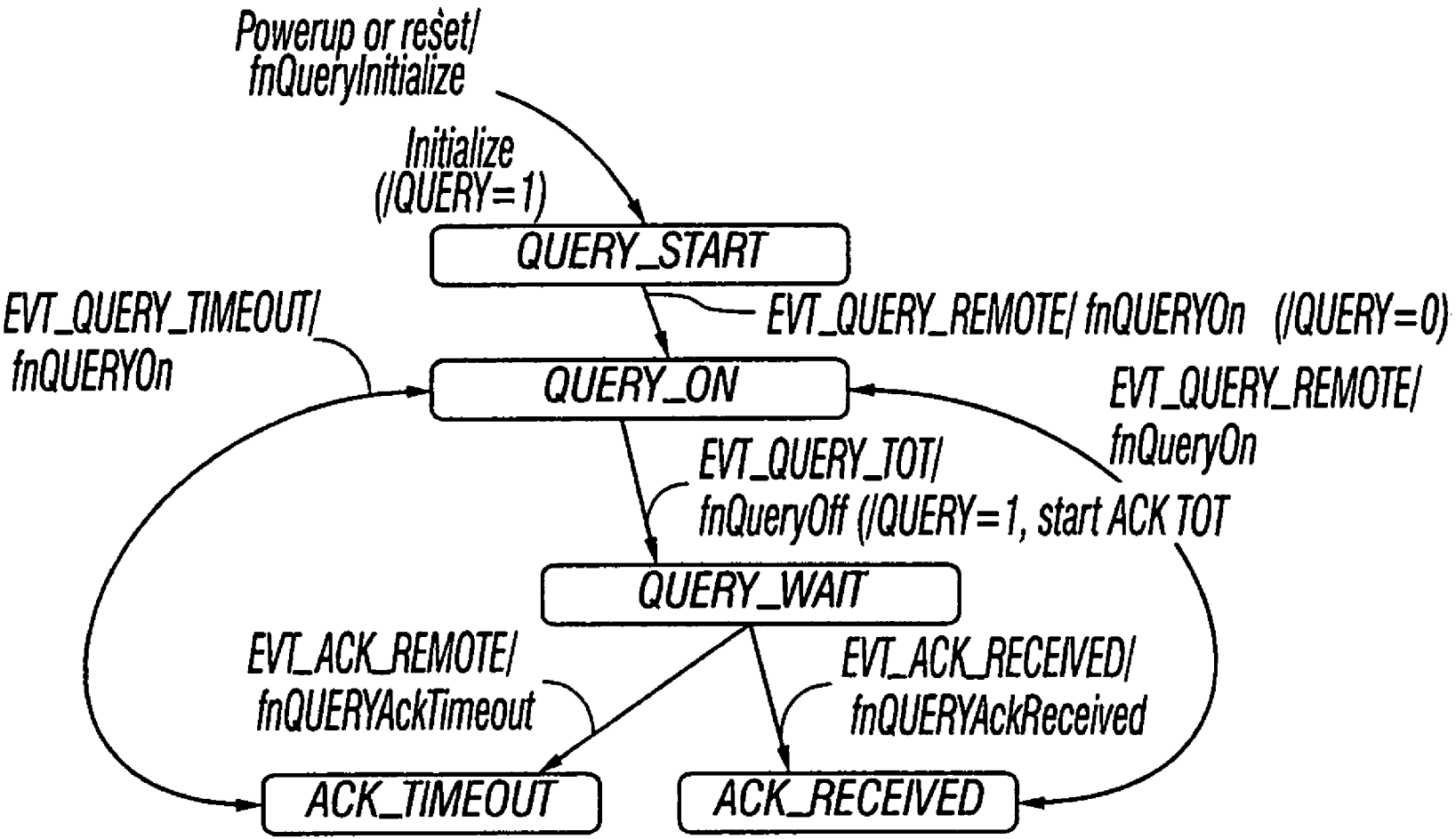
FIG. 5 is a query state transition diagram for the barrier operator system of the invention.

Still further, the control system of the invention contemplates certain states, certain events and certain actions for a so-called query state machine. A state transition diagram for the query state machine is illustrated in FIG. 5. The states for the query state machine, events for same and actions for same are as follows.

States For The Query State Machine are as follows: QUERY_START is the initial idle or powerup/reset state. The output/QUERY will be initialized to a logic '1'. QUERY_ON is the state entered when the event EVT_QUERY_REMOTE occurs. In this state, the output/QUERY will be set to logic '0' in order to begin the query process to the remote unit 46, for example. QUERY_WAIT state is reached when the timeout timer for /QUERY output expires, i.e., the event EVT_QUERY_TOT occurs. In this state, the /QUERY output is returned to the logic '1' state. ACK_RECEIVED is the state reached if a remote control unit 46 or 48 responds to the query sent by controller 36 (in the event EVT_ACK_RECEIVED occurs). ACK_TIMEOUT is the state reached if the remote control unit does not respond within a predetermined number of seconds (the event EVT_ACK_TIMEOUT occurs).

Events For The Query State Machine are as follows: Powerup or reset is the initial state. EVT_QUERY_REMOTE is the event sent by the main state machine to the query state machine in order to begin the query process of the remote unit by the base unit. EVT_ACK_RECEIVED event occurs if the /ACK input is set momentarily to a logic active low. EVT_ACK_TIMEOUT event occurs if the time exceeds the maximum allowed time for the remote unit to respond to a query command.

Actions For The Query State Machine are as follows: fnQueryInitialize function should set the /QUERY output to a logic '1' and initialize any variables used by this state machine. The fnQueryOn function will set the /QUERY output to a logic '0' thereby beginning the query command to the remote unit. The /QUERY output will be pulsed '1', '0', '1' for a predetermined number of milliseconds. The fnQueryoff function will set the /QUERY output to a logic '1'. The fnQueryAckTimeout function will be called in response to the state machine receiving the EVT_ACK_TIMEOUT event. The fnQueryAckReceived function will be called in response to the state machine receiving the EVT_ACK_RECEIVED event.

Accordingly, many operational scenarios may be contemplated by the system 21 of the invention. The remote control units 46 and 48 will each include an onboard power supply, not shown in the drawings, such as a battery, and the controller or processor 62, for each of the remote control units will be operable to manage the operation of the remote control units in such a way that minimum power is consumed except, of course, when one of the switches 46*a*, 48*a* or 46*b*, 48*b* is actuated or the remote control unit receives a query from the transmitter 54, for example. However, depending on the state of the operator system 21, the remote control units 46 and 48 may ignore a query signal or the query signal will not be repeated by transmission from the transmitter 54 until the operator system undergoes another change of state.

If the door 20 is closed manually by actuation of switch 40 or switch 46*a*, for example, and the controller 36 sends a signal to the remote control units 46 and 48 and unit 46, at least, responds, indicating it is within range, a signal is sent via the transmitter 54 advising the remote control unit 46 that it is in a standby mode and does not need to respond to a signal from the controller 36. Accordingly, if one of the remote control units 46 or 48 is in the garage and the door has been closed manually, that is by actuation of the switch 40, for example, the door 20 will remain in the closed position. However, the controller 36 may continue to send a periodic query signal a predetermined number of times via the transmitter 54 "searching" for the other remote control unit so that when the other remote control unit is within range and a signal is received by the other control unit, the other remote control unit sends a command signal to receiver 56 and the door 20 is opened automatically by the controller 36.

Another scenario contemplated is that the door 20 is closed manually by actuation of the switch 40 which initiates periodic transmissions from transmitter 54 searching for one or the other of the remote units 46 or 48. Even if no response signal is received by way of a transmitter 60, for example, the controller 36 may continue to periodically send a query signal via the transmitter 54 "in search" of a remote control unit 46 and/or 48. Once a response is received from one of the remote control units under such a condition, the control circuit 50 will effect opening of the door 20.

Another operating scenario contemplated is the opening of the garage door 20 manually by actuation of the switch 40 or an equivalent thereof. This change of state will cause the controller 36 to begin sending a periodic signal from the transmitter 54 "searching" for the remote control units 46 and 48. If a remote control unit is located within range and generates a response signal, the door 20 remains in the open position as long as a remote control unit 46 or 48 remains within range of the controller 36. However, if the garage door is opened manually and neither remote control unit responds to a query signal, the processor 70 may be programmed to maintain the door in the open position until another event occurs.

Accordingly, if the door 20 is opened manually and the controller 36 begins querying the remote control units 46 and 48 and the remote control units are out of range, the controller 36 will continue in the query mode. A change of state would occur only if the remote control units became out of range after the controller 36 confirmed their presence and action would occur only after such a change in the status of the remote control units. Accordingly, if a user of the system 21 opened the garage door 20 manually by actuation of the control switch 40, then left in their vehicle with remote control unit 46 (assume this is the only remote control unit being used), once the remote control unit was out of range, the controller 36 would effect closing of the door. If the door 20 were opened manually by actuation of the switch 40 and the remote control unit was already out of range, the controller 36 would continue to remain in a query mode by sending a periodic signal from transmitter 54 "searching" for a remote control unit but the door would remain open.

Of course, if the door 20 is closed automatically by the controller 36, as a consequence of one or both of the remote control units moving out of range of the transmitter 54, the controller 36 may continue to send a periodic signal from the transmitter 54 searching for same. If there is no response, the door 20 remains in the closed position. Moreover, if there are two remote control units in use and at least one stays within range of the transmitter 54, the controller 36 may continue to send a periodic signal, searching for the remote control unit that has moved out of range. Since the other remote control unit has remained within range, it will not respond with a signal to effect opening of the door 20 or controller 36 will ignore its signal since such remote unit never moved out of range.

Still further, in the operating mode wherein the controller 36 detects a remote control unit moving into range and receives a command signal from a transmitter 60, the door 20 will be opened automatically and will stay open as long as the remote control unit remains within range. Accordingly, the door 20 will be closed only if a signal is received from a transmitter 60 as a consequence of actuating one of the push button switches 46*a* or 46*b* or the controller receives a signal from switch 40 to effect manual closing of the door. Moreover, if the door 20 is caused to open automatically as a consequence of a remote control unit 46 or 48 moving into range, and the remote control unit in question then moves out of range, the controller 36 will be operated to effect closing of the door after a predetermined time delay.

The above described operational scenarios are among the more common ones contemplated by the present invention. Of course, if the obstruction detector 42, 44 detects an obstruction anytime the door 20 is moving toward a closed position, the door movement will be reversed and the door moved to an open position and remain there until a signal indicating an obstruction ceases, that is the obstruction has been removed. The door 20 may also be closed by a manual closing signal by actuation of the switch 40 or manual actuation of the switches of one of the remote control units 46 or 48.

The construction and operation of the automatic barrier operator system described and shown is believed to be within the purview of one skilled in the art based on the foregoing description. Although a preferred embodiment of an automatic barrier operator system and methods of operation have been described in detail herein, those skilled in the art will recognize that various substitutions and modifications may be made without departing from the scope and spirit of the appended claims.

What is claimed is:

1. A method for operating a barrier, such as a gate or garage door, to move between open and closed positions, said barrier being operably connected to an operator system including a controller comprising a base control circuit, said controller being operable to track whether said barrier is automatically or manually moved into position by said controller, a human operator controllable base switch operably connected to said base control circuit, a radio frequency base transmitter, a radio frequency base receiver and first and second remote control units operable to communicate with said base control circuit by way of said base receiver, each of said remote control units including a radio frequency remote transmitter and a radio frequency remote receiver, said method comprising the steps of:

transmitting a radio frequency query signal to said remote receivers;

receiving an automatic reply signal from a remote transmitter of one of said first and second remote control units at said base receiver in response to said query signal, said reply signal including a signal characteristic identifying said first remote control unit from said second remote control unit; and causing said base control circuit to effect one of opening and closing said barrier dependent on said base receiver receiving said reply signal from said one remote control unit and dependent on whether said barrier was automatically or manually moved to its present position by said controller.

2. The method set forth in claim 1 including the steps of:

actuating said base switch to effect closing of said barrier;

causing said controller to make a determination whether all of said remote control units are within a range of said controller effective to receive signals from all of said remote transmitters; and causing said controller to initiate operation of said base transmitter to cease transmitting signals to said remote receivers in response to the determination that all of said remote control units are within said range.

3. The method set forth in claim 1 including the steps of:

actuating said base switch to cause said barrier to move to a closed position;

causing said controller to verify that at least one of said remote control units is out of a range to receive a signal from a remote transmitter of said at least one remote control unit; and causing said controller to effect operation of said base transmitter to transmit at least periodic signals in search of said at least one remote control unit.

4. The method set forth in claim 1 including the steps of:

causing said barrier to close in response to at least one of said remote control units moving out of range of one of a signal transmission from said base transmitter to said one remote control unit and a signal transmission from said one remote control unit to said base receiver.

5. The method set forth in claim 1 including the steps of:

actuating said base switch to effect opening of said barrier;

causing said base transmitter to transmit a signal; and causing said controller to maintain said barrier in an open condition as long as said controller receives a signal from at least one remote transmitter.

6. The method set forth in claim 1 including the steps of:

causing said controller to effect closing of said barrier; and causing said controller to initiate operation of said base transmitter to cease transmission of signals from said base transmitter in response to said base receiver receiving a signal from all of said remote control units.

7. The method set forth in claim 1 including the steps of:

actuating said base switch to effect opening of said barrier; and causing said controller to operate said base transmitter to transmit signals to said remote control units as long as any one of said remote control units is out of range for receiving a signal from said base transmitter or any one of said remote control units is out of range of said base receiver receiving a signal from said one remote control unit.

8. The method set forth in claim 1 including the step of:

causing said controller to effect closing of said barrier after a predetermined time commencing with opening of said barrier if none of said remote transmitters are within a range to cause said base receiver to receive signals therefrom.

9. The method set forth in claim 1 wherein:

said remote control units each include a human operator controllable remote switch operably connected to a remote transmitter, respectively, and said method includes the steps of:

actuating one of said remote switches to effect closing said barrier;

causing said controller to maintain said barrier in a closed position if at least one of said remote receivers is outside a signal receiving range of a signal from said base transmitter and another one of said remote receivers is in a signal receiving range of said base transmitter.

10. The method set forth in claim 1 wherein:

said remote control units each include a human operator controllable remote switch operably connected to a remote transmitter, respectively, and said method includes the steps of:

actuating one of said remote switches to effect closing said barrier; and causing said base transmitter to send periodic signals searching for one of said remote control units.

11. The method set forth in claim 1 including the steps of:

causing said controller to open said barrier; and causing said controller to maintain said barrier in an open position if one of said remote control units is in signal receiving range of said base transmitter.

12. The method set forth in claim 11 including the step of:

causing said controller to close said barrier if said one remote control unit and said controller cease to be in signal receiving range of each other.

13. The method set forth in claim 1 wherein:

said remote control units each include a human operator controlled remote switch operably connected to a remote transmitter, respectively, and said method includes the steps of:

causing said controller to initiate opening of said barrier in response to said base receiver receiving a signal from a remote transmitter; and causing said controller to close said barrier only ever in response to actuation of one of said switches.

14. A method for operating a barrier, such as a gate or garage door, to move between open and closed positions, said barrier being operably connected to an operator system including a controller comprising a base control circuit, said controller being operable to track whether said barrier is automatically or manually moved into position by said controller, a radio frequency base transmitter and a radio frequency base receiver and first and second remote control units operable to communicate with said base control circuit, said remote control units each including a radio frequency remote transmitter and a radio frequency remote receiver, said method comprising the steps of:

transmitting a radio frequency query signal to said remote receivers of said first and second remote control units; and effecting one of opening and closing said barrier depending on whether or not said base receiver receives a reply signal from said remote transmitter of said first remote control unit and depending on whether said barrier was automatically or manually moved to its present position by said controller, said reply signal being automatically generated in response to said query signal and including a signal characteristic identifying said remote transmitter of said first remote control unit from said remote transmitter of said second remote control unit.

15. The method set forth in claim 14 including the step of:

causing said controller to move said barrier from a closed position to an open position in response to a signal from said remote transmitter of said first remote control unit; and causing said controller to hold said barrier in an open position as long as said first remote control unit is within a radio frequency communication range of said controller.

16. The method set forth in Clam 14 wherein:

said operator system includes a human operator controllable base switch operably connected to said base control circuit, and said method further includes the steps of:

causing said base transmitter to transmit a radio frequency signal to said remote receivers;

actuating said base switch to effect opening of said barrier; and causing said controller to maintain said barrier in an open condition as long as said base receiver receives a signal from at least one said remote transmitter.

17. The method set forth in claim 14 wherein:

at least said one remote control unit includes a human operator controllable remote switch, said method further includes the steps of:

causing said base transmitter to transmit a radio frequency signal to said remote receivers;

actuating said remote switch to effect closing said barrier; and causing said controller to maintain said barrier in a closed position if at least one of said remote receivers is outside a signal receiving range of a signal from said base transmitter and another one of said remote receivers is in signal receiving range of said base transmitter.

18. The method set forth in claim 14 wherein:

said operator system includes a human operator controllable base switch operably connected to said base control circuit, and each of said remote control units including a human operator controllable remote switch operably connected to a remote transmitter, said method further comprising the steps of:

causing said controller to close said barrier in response to actuation of one of said switches;

causing said base transmitter to transmit a radio frequency signal to said remote receivers; and causing said controller to open said barrier when said base receiver receives a signal from one of said remote transmitters in response to a signal from said base transmitter received by a remote receiver operably connected to said one remote transmitter.

19. The method set forth in claim 18 including the steps of:

actuating one of said switches to cause said operator system to close said barrier;

causing said base transmitter to transmit a radio frequency signal to said remote receivers;

transmitting an acknowledgement signal from any of said remote control units which has received a signal from said base transmitter;

sending an additional signal from said base transmitter to said any one remote control unit to cause a remote transmitter associated with said any one remote control unit to cease responding to a signal from said base transmitter;

causing said base transmitter to continue to send a periodic signal searching for any of said remote units which has not responded to a signal from said base transmitter; and causing said operator system to move said barrier to an open position in response to receiving a signal by said base receiver from a remote transmitter which has moved into range of signals between said base transmitter and said remote transmitter which has moved into said range.

20. The method set forth in claim 18 including the steps of:

actuating said base switch to cause said operator to open said barrier;

causing said base transmitter to emit signals in response to actuating said base switch to search for said remote control units; and causing said controller to maintain said barrier in an open position as long as said base receiver receives a signal from at least one of said remote control units in response to said search signal from said base transmitter.

21. The method set forth in claim 18 including the steps of:

actuating one of said switches to cause said operator system to open said barrier;

causing said base transmitter to emit a search signal in response to actuating said one switch to search for said remote control units; and causing said controller to maintain said barrier in an open position as long as said base receiver fails to receive a signal from one of said remote control units in response to said search signal from said base transmitter.

22. The method set forth in claim 18 including the steps of:

causing said base transmitter to transmit a search signal to said remote control units;

causing said controller to open said barrier if one of said remote control units moves into range of said search signal; and causing said controller to open said barrier if said one remote control unit then moves out of range of said search signal.

* * * * *